US006739310B2

(12) United States Patent
Esteghlal et al.

(10) Patent No.: US 6,739,310 B2
(45) Date of Patent: May 25, 2004

(54) METHOD AND ELECTRONIC CONTROL DEVICE FOR DIAGNOSING THE MIXTURE PRODUCTION IN AN INTERNAL COMBUSTION ENGINE

(75) Inventors: Gholamabas Esteghlal, Ludwigsburg (DE); Dieter Lederer, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,403

(22) PCT Filed: Aug. 29, 2001

(86) PCT No.: PCT/DE01/03301

§ 371 (c)(1),
(2), (4) Date: Sep. 30, 2002

(87) PCT Pub. No.: WO02/20969

PCT Pub. Date: Mar. 14, 2002

(65) Prior Publication Data

US 2003/0075140 A1 Apr. 24, 2003

(51) Int. Cl.[7] ..... F02M 33/02

(52) U.S. Cl. ..... 123/295; 123/305; 123/698; 123/520; 73/118.2

(58) Field of Search ..... 701/103, 104, 701/107; 123/295, 690, 698, 365, 443, 516, 518, 519, 520, 521, 198 D, 672, 688; 73/117.2, 117.3, 118.1, 118.2, 117.1

(56) References Cited

U.S. PATENT DOCUMENTS

| | | | | | |
|---|---|---|---|---|---|
| 4,584,982 | A | | 4/1986 | Clement et al. | 123/498 |
| 5,186,153 | A | * | 2/1993 | Steinbrenner et al. | 123/519 |
| 5,284,050 | A | * | 2/1994 | Iida et al. | 73/118.1 |
| 5,634,454 | A | | 6/1997 | Fujita | 123/690 |
| 5,754,971 | A | * | 5/1998 | Matsumoto et al. | 701/103 |
| 5,950,606 | A | * | 9/1999 | Iida et al. | 123/672 |
| 6,047,692 | A | * | 4/2000 | Toyoda | 123/698 |
| 6,161,530 | A | * | 12/2000 | Kakizaki et al. | 123/674 |
| 6,253,744 | B1 | * | 7/2001 | Saruwatari et al. | 123/520 |
| 6,564,782 | B2 | * | 5/2003 | Fujimoto et al. | 123/520 |

FOREIGN PATENT DOCUMENTS

| | | | | |
|---|---|---|---|---|
| DE | 198 50 586 | | 5/2000 | |
| DE | 198 51 990 | | 6/2000 | |
| JP | 09 242587 | | 9/1997 | |
| JP | 210569 | * | 8/1999 | F02M/25/08 |
| JP | 329894 | * | 11/2001 | F02D/41/14 |

* cited by examiner

*Primary Examiner*—Gimie Mahmoud
*Assistant Examiner*—Hai Huynh
(74) *Attorney, Agent, or Firm*—Kenyon & Kenyon

(57) ABSTRACT

A method and an electronic control device for diagnosing the mixture formation in internal combustion engines including tank ventilation. The diagnosis is linked to the mixture adaptation and is performed only with active lambda control and, therefore, especially not in operating modes of the internal combustion engine in which lambda is merely controlled. In the method, outside of active lambda control, an indication of a mixture or probe fault is recognized in that, given active tank ventilation and non-active mixture adaptation, a fault suspicion is formed when a measurement for the influence of the tank ventilation on the mixture composition, the measurement is formed assuming an intact system, takes on implausible values. If this suspicion exists, the mixture adaptation is requested to verify the suspicion, if appropriate.

11 Claims, 2 Drawing Sheets

METHOD AND ELECTRONIC CONTROL DEVICE FOR DIAGNOSING THE MIXTURE PRODUCTION IN AN INTERNAL COMBUSTION ENGINE

FIELD OF THE INVENTION

The present invention relates to a method for diagnosing the mixture formation in internal combustion engines including tank ventilation.

BACKGROUND INFORMATION

It is conventional to superpose a precontrol with a closed-loop control in controlling the air-fuel ratio for internal combustion engines. Furthermore, it is conventional to derive further correcting quantities from the behavior of the controlled variable to compensate for incorrect adaptations of the precontrol in response to changed operating conditions. This compensation is also referred to as adaptation. U.S. Pat. No. 4,584,982, for instance, describes an adaptation using different adaptation quantities in different ranges of the load/rotational speed spectrum of an internal combustion engine. The different adaptation quantities relate to the compensation of different faults. Based on cause and effect, a distinction may be made between three kinds of faults: faults in a hot-film air-mass meter have a multiplicative effect on the fuel metering. Leakage-air impacts have an additive effect per time unit, and faults in the compensation of the pickup time of the injectors have an additive effect per injection.

In accordance with mandatory regulations, emission-relevant faults are to be detected by an on-board arrangement and a fault light is activated, if appropriate. The mixture adaptation is also used in fault diagnosis. For instance, a fault is indicated if the corrective adjustment of the adaptation is excessive.

The diagnosis of the fuel-supply system is linked to the mixture adaptation, which may only run during active lambda control, that is, especially not in operating modes in which lambda is merely controlled (for example, in stratified operation with direct fuel injection (BDE), in uncontrolled lean-combustion operation with BDE and in intake-manifold injection).

Thus, for the adaptation, a switch to homogenous operation occurs and the mixture adaptation is activated.

An engine control program is referred to in German Published Patent Application No. 1 98 50 586, which controls the switchover between stratified operation and homogeneous operation.

In stratified operation, the engine is operated with a heavily stratified cylinder charge and a high excess of air, so as to keep the fuel consumption as low as possible. The stratified charge is obtained by retarded fuel injection, which ideally leads to a division of the combustion chamber into two zones: The first zone contains the combustible air-fuel mixture at the spark plug. It is surrounded by the second zone, consisting of an insulating layer of air and residual gas. The potential for optimizing fuel consumption results from the possibility of operating the engine mostly without throttle control while avoiding charge-cycle losses. With comparatively low charge, stratified operation may be preferred.

With higher charge, when the primary goal is to optimize performance, the engine is operated with homogeneous cylinder charge. The homogeneous cylinder charge results from early fuel injection during the intake step. In this manner, there is more time available to form the mixture before combustion occurs. The potential for optimizing performance offered by this operating mode results, for instance, from utilizing the entire combustion-chamber volume for the filling with combustible mixture.

Several activation conditions exist for adaptation:

For instance, the engine temperature has reached the activation-temperature threshold, and the lambda probe is operative. Furthermore, the instantaneous values of charge and speed are each within certain ranges in which learning occurs. This is referred to in U.S. Pat. No. 4,584,982, for instance. Also, homogeneous operation is given.

SUMMARY OF THE INVENTION

The present invention seeks to expand the time period during which the engine may be operated in stratified operation at optimum fuel consumption. The switch-over to homogeneous operation for diagnostic purposes reduces the fuel-consumption advantage of direct fuel injection, since homogeneous operation is less economical than stratified operation. Therefore, switching to homogeneous operation causes an unnecessary increase in fuel consumption in those cases where no fault is present. It should be avoided whenever possible, without decreasing the chance of detecting faults related to exhaust gas.

This desired effect is achieved by a method for diagnosing the mixture formation in internal combustion engines including combustion chambers and tank ventilation. In this context, the diagnosis is linked to mixture adaptation, which only runs during active lambda control and in which, outside of active lambda control, an indication of a mixture or probe fault is detected by generation of a fault suspicion during active tank ventilation and non-active mixture adaptation in those cases where a measurement for the influence of the tank ventilation on the mixture composition, which is formed assuming an intact system, takes on implausible values. When this is suspected, the mixture adaptation is requested, so that the assumption may either be verified or falsified.

In a further refinement of the present invention, the internal combustion engine is operated with direct fuel injection into the combustion chambers.

A further refinement distinguishes itself by the internal combustion engine being operated, in at least one first operating mode, using stratified mixture distribution in the combustion chambers (stratified operation) and, in a second operating mode, using homogeneous mixture distribution in the combustion chambers (homogeneous operation) and an indication of a mixture or probe fault (fault suspicion) is detected outside of active lambda control, in stratified operation.

A further measure provides that a switchover to homogeneous operation occurs for diagnostic purposes when an indication of a mixture or probe fault (fault suspicion) is detected in stratified operation, so that the fault suspicion may be verified or falsified.

A further measure provides for the use of a control device to control a tank ventilation system 12 and further functions in order to achieve efficient combustion of the fuel/air mixture in the combustion chamber, the tank ventilation system 12 including an activated carbon-filter 18, which is connected via appropriate lines or connections to the tank, the ambient air, and to the intake manifold of the internal combustion engine, and which also includes a tank ventilation valve 16 arranged in the line to the intake manifold.

According to another further refinement, a precontrol value rk for a fuel-metering signal for fuel injection into at least one of the combustion chambers is formed as a function of at least speed n, and a signal ml is generated regarding the air quantity drawn in by the internal combustion engine. A faulty adaptation of the fuel quantity to the air quantity is reflected in signal Us of an exhaust-gas analyzer probe, from which a controller 2.3 forms a controlled variable fr, which reduces the faulty adaptation by a multiplicative linking with precontrol value rk.

A further measure provides for the formation of an adaptation operation fra of the fuel-metering signal formation, by forming an average value frm of control variable fr, and by correcting the fuel-metering signal formation by an adaptation-operation variable fra, which is based on the mentioned average value.

An additional measure provides that tank ventilation but no mixture adaptation occurs in stratified operation.

According to a further refinement, the influence of the regeneration gas on the composition of the total fuel/air ratio given active tank ventilation is derived from the signal of a lambda probe, from which the fuel concentration (=charge) of the regeneration gas is learned (adapted), and the fuel portion introduced via the Tank Ventilation Valve(TEV) calculated using the following input variables:

signal of exhaust-gas analyzer probe;

measured intake air quantity;

fuel quantity metered via injectors;

regeneration-gas quantity, derivable from the control pulse-duty factor for the tank-ventilation valve and further boundary conditions.

A further refinement provides that a fault is set in those cases where the charge of the regeneration gas of the Tank Ventilation (TV) is outside a plausible range.

The present invention also relates to an electronic control device for implementing the methods in accordance with the aforementioned methods and further refinements for diagnosing a mixture formation.

Therefore, the present invention represents a method for diagnosing the mixture formation in internal combustion engines including tank ventilation, the diagnosis is linked to the mixture adaptation and is only able to execute given active lambda control. Therefore, the mixture adaptation especially does not run in operating modes of the internal combustion engine in which lambda is merely controlled. The method distinguishes itself by the fact that, outside of active lambda control, an indication of a mixture or probe fault is also recognized in stratified, or lean operation, e.g., in DFI, but basically also in lean operation in manifold injection. For that purpose, a fault suspicion is set with active tank ventilation and non-active mixture adaptation. If, in this context, a measurement for the influence of the tank ventilation on the mixture composition, which is formed assuming an intact system, takes on implausible values, the mixture adaptation is requested in order to possibly verify the suspicion.

Indicating a suspected fault for the mixture during tank ventilation may be advantageous in case of DFI-engines, since faults may be detected not only in stratified but also in homogenous operation, and activation of the mixture adaptation is thus possible. The mixture adaptation itself requires active lambda control, i.e., homogeneous operation, and, may thus not be activated and is unable to detect faults in stratified operation. A switchover to homogenous operation merely for diagnostic purposes occurs only if a reason exists for suspecting a fault, in this manner preventing an undesired limitation of stratified operation.

An example embodiment of the present invention is hereinafter explained with reference to the Figures.

DETAILED DESCRIPTION

Figure 1:
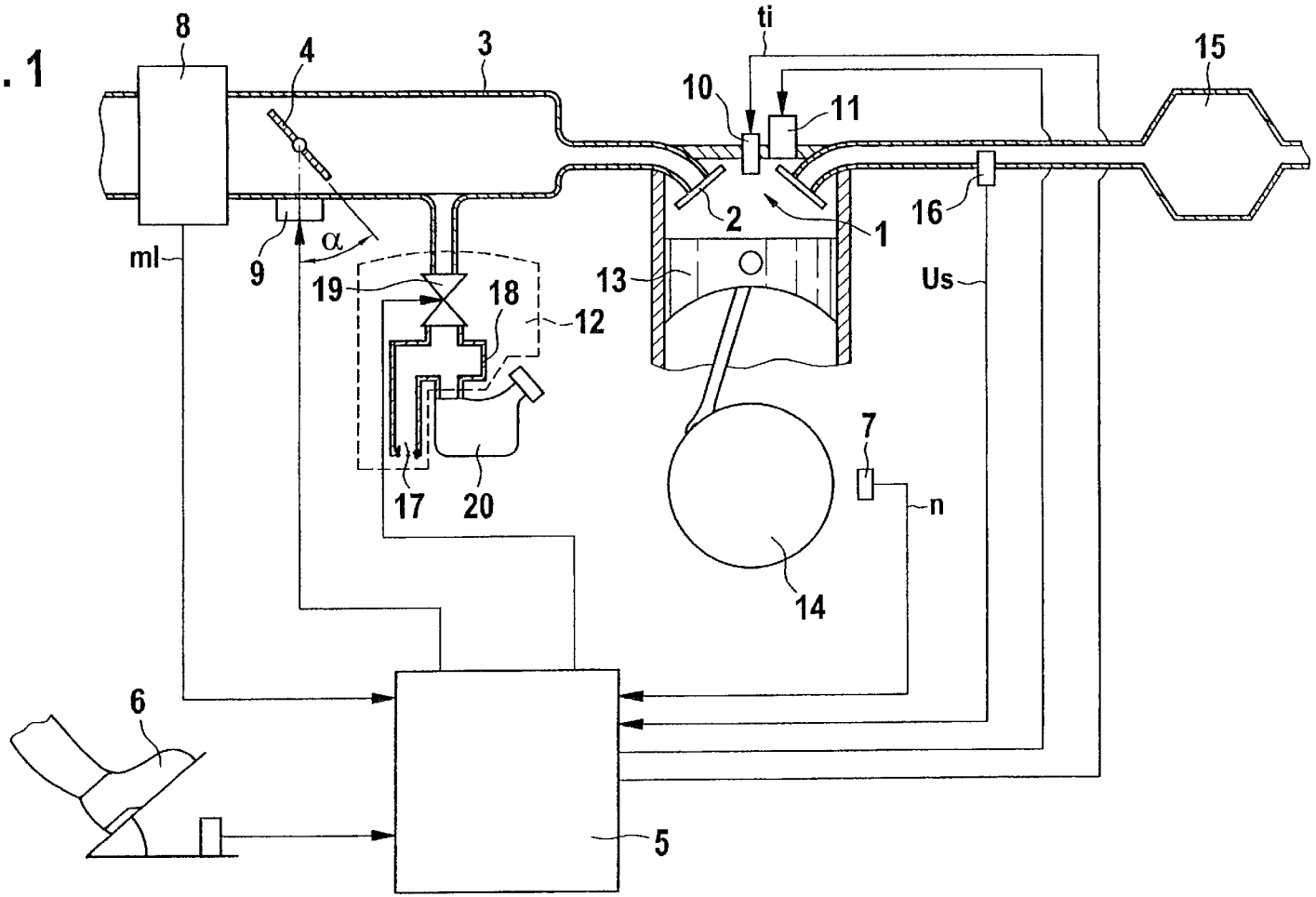
FIG. 1 shows the technical field of the present invention.

The reference number 1 in FIG. 1 represents the combustion chamber of a cylinder of an internal combustion engine. The flow of air into the combustion chamber is controlled via intake valve 2. The air is drawn in via an intake manifold 3. The intake-air quantity may be varied using a throttle valve 4, which is controlled by control device 5. Signals regarding the torque request of the driver, such as the position of an accelerator 6, a signal regarding the rotational engine speed n of a speed sensor 7 and a signal regarding quantity ml of the drawn-in air, are supplied by an air-flow sensor 8, and a signal Us regarding exhaust-gas composition and/or exhaust-gas temperature supplied by an exhaust-gas sensor 16, are fed to the control device. Exhaust-gas sensor 16 could be, for instance, a lambda probe, whose Nernst voltage indicates the oxygen content of the exhaust gas. The exhaust gas is conveyed through at least one catalytic converter 15, in which pollutants in the exhaust gas are converted and/or stored temporarily.

From these and possibly other input signals regarding further parameters of the internal combustion engine, such as intake air and coolant temperature and others, control device 5 generates output signals for adjusting throttle-valve angle alpha by an actuator 9, and for controlling a fuel injector 10, which dispenses the fuel into the combustion chamber of the engine. In addition, the control device controls the triggering of the ignition via an ignition device 11.

Throttle-valve angle alpha and the injection-pulse width ti are controlled variables that are adjusted to each other to achieve the desired torque. A further, controlled variable for influencing torque is the angular position of the ignition relative to the piston travel. Determining the controlled variables for torque adjustment is referred to in German Published Patent Application No. 1 98 51 990.

The control device also controls a tank ventilation 12 as well as other functions for achieving an efficient combustion of the fuel/air mixture in the combustion chamber. The gas force resulting from the combustion is converted into torque by piston 13 and crank operation 14.

Tank ventilation system 12 includes an activated-carbon filter 18, which communicates via appropriate lines or terminals with tank 20, ambient air 17 and the intake manifold of the internal combustion engine, a tank ventilation valve 19 is located in the line to the intake manifold.

Activated-carbon filter 18 stores evaporating fuel evaporating in tank 20. As tank-ventilation valve 19 is opened by control device 5, air is drawn in from ambiency 17 through the active-charcoal filter, which releases the stored fuel into the air. This fuel/air mixture, also referred to as tank-ventilation mixture or also as regeneration gas, influences the composition of the entire mixture supplied to the internal combustion engine. It should be mentioned, too, that the fuel portion of the mixture is further determined by metering fuel via fuel metering device 10, which is adjusted to the indrawn air volume. In extreme cases, the fuel drawn in via the tank-ventilation system may constitute approximately one-third to one-half of the entire fuel quantity.

Figure 2:
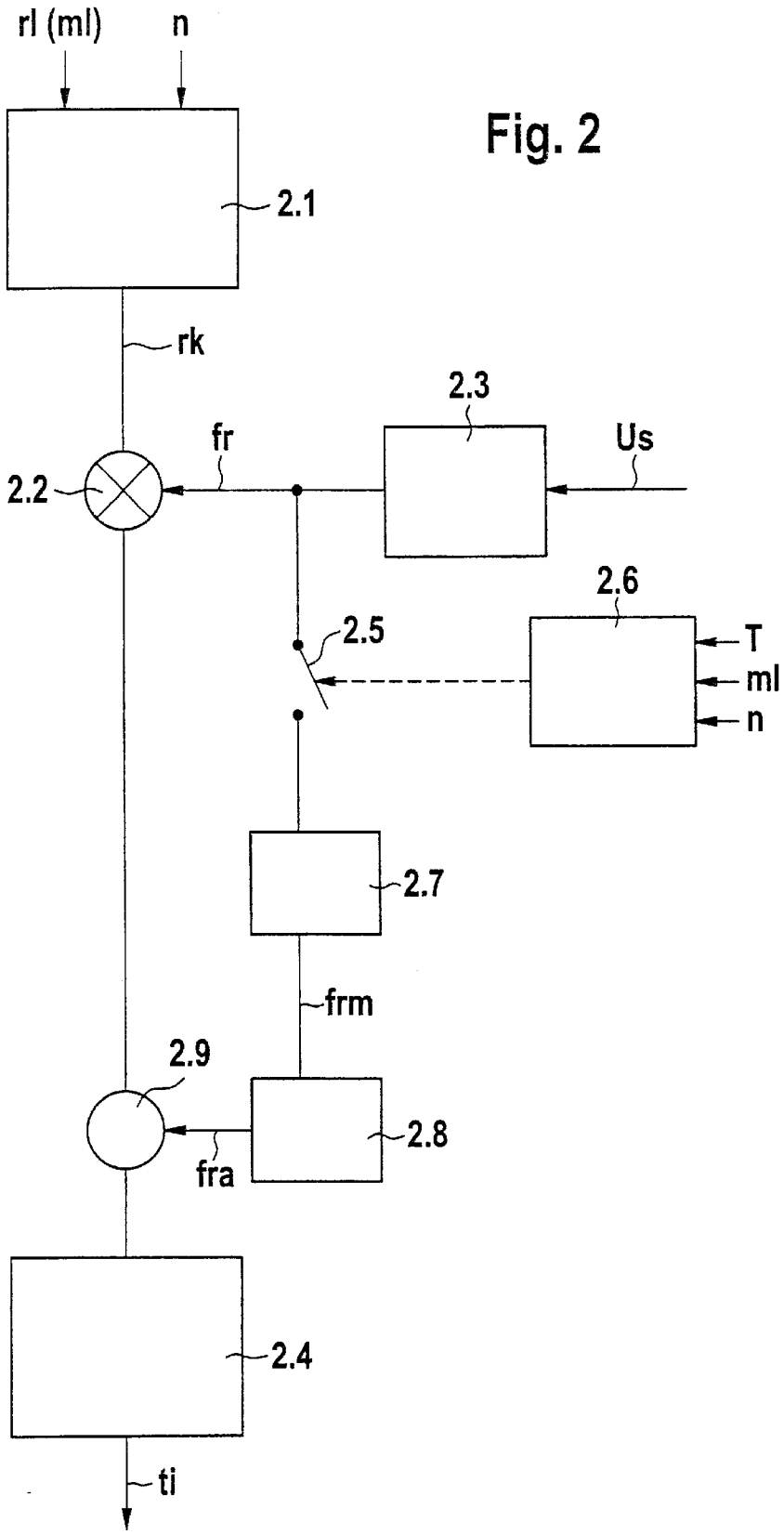
FIG. 2 shows the formation of a fuel-metering signal on the basis of the signals from FIG. 1, and the functioning of an adaptation.

FIG. 2 shows the formation of a fuel-metering signal on the basis of the signals from FIG. 1, and the functioning of an adaptation.

Block 2.1 represents a characteristics map, which is addressed by rotational speed n and the relative air charge rl, and in which precontrol values rk for generating the fuel-metering signals are stored. Relative air charge rl is related to a maximum charge of the combustion chamber with air and, to some extent, thus indicates the fraction of the maximum combustion chamber or cylinder fill. It is generated from signal ml. rk corresponds to the fuel quantity associated with air quantity rl.

Block 2.2 shows the known multiplicative lambda control adjustment. A faulty adaptation of the fuel quantity to the air quantity is reflected in signal Us of the exhaust-gas probe. A controller 2.3 forms controlled variable fr therefrom, which reduces the faulty adaptation via adjustment 2.2.

From the thus corrected signal, the metering signal, for instance a control pulse width for the fuel injectors, may already be generated in block 2.4. Block 2.4, therefore, represents the conversion of the relative and corrected fuel quantity into an actual control signal, taking into account the fuel pressure, injector geometry, etc.

Blocks 2.5 through 2.9 represent the known mixture adaptation based on operating parameters, which may have a multiplicative and/or an additive effect. Circle 2.9 is meant to represent these three possibilities. Switch 2.5 is opened or closed by arrangement 2.6, operating parameters of the internal combustion engine, such as temperature T, air quantity ml and rotational speed n are supplied to arrangement 2.6. Arrangement 2.6 in conjunction with switch 2.5 thus allows an activation of the three named adaptation possibilities as a function of operating-parameter ranges. The formation of adaptive operation fra for the fuel-metering signal generation is shown by blocks 2.7 and 2.8. Block 2.7 forms the average value frm of controlled variable fr when switch 2.5 is closed. Deviations of average value frm from neutral value 1 are incorporated by block 2.8 into adaptation-operation variable fra. For instance, controlled variable fr, due to a faulty adaptation of the precontrol, would first go toward 1.05.

Block 2.8 incorporates the 0.05 deviation from value 1 into value fra of the adaptive operation. In case of a multiplicative fra-operation, fra then goes toward 1.05, with the result that fr will go toward 1 again. In this manner, the adaptation ensures that faulty adjustments of the precontrol do not require renewed adjustment at each change of operating points.

This adjustment of adaptive variable fra is implemented at high temperatures of the internal combustion engine, for instance, above a cooling-water temperature of 70° Celsius, switch 2.5 is then closed. However, once adjusted, fra has an effect on the generation of the fuel-metering signal even when switch 2.5 is open.

The solution according to the present invention is based on the fact that no mixture adaptation is implemented in stratified operation, but tank ventilation will occur.

Tank ventilation is used to equalize the pressure between fuel tank and ambiency, which, for instance, is required in case of increased fuel evaporation due to warming or a decrease in ambient pressure. The fuel contained in the fuel vapor is absorbed in an activated-carbon filter (AKF), which has to be emptied on a regular basis due to its limited absorption capacity. This is done by supplying the stored fuel (=regeneration gas) for combustion via the tank ventilation valve (TEV).

In doing so, the fuel concentration (=charge) of the regeneration gas may be adapted, based on the influence of the regeneration gas on the composition of the total fuel/air ratio, which may be derived from the signal of a lambda probe, and the fuel portion introduced via the TEV may be calculated. In addition to the lambda-probe signal, input variables in this calculation are the measured intake-air quantity, the fuel quantity metered via the injectors, and the regeneration-gas quantity, which is derivable from the pulse control factor of the tank ventilation valve and additional boundary conditions. A particular (known) intake-air quantity and a particular (known) fuel quantity metered via the injectors, in connection with a certain (known) regeneration-gas quantity and a certain (unknown) fuel evaporation portion of the regeneration-gas quantity, result in a particular oxygen concentration in the exhaust gas. Through a (known) oxygen concentration, measured by an exhaust-gas analyzer probe, the desired charge results from calculation.

If the charge of the regeneration gas of the TV thus determined is outside a plausible range, a fault suspicion is set in accordance with the present invention.

On the basis of the determined regeneration-gas charge, the fuel share of the tank ventilation in the total fuel quantity is determined. This fuel portion is the controlled variable of the tank ventilation, which is controlled to a setpoint value preselected as a function of operating points. For instance, at one particular operating point perhaps 30% of the total fuel quantity are to flow via the tank ventilation valve, while the other 70% are injected via fuel injectors.

Furthermore, this fuel portion is limited to predetermined limiting values as a function of the total fuel quantity, for instance to 50%. If no fault is present, these limiting values are not reached.

During active tank ventilation, a mixture or probe fault occurring outside of the tank ventilation is interpreted as charging of the regeneration gas. The actual charge then does not correspond to the calculated charge. In that case, the mentioned limiting values may be reached. If, at the same time, a mixture-control factor is no longer within a predetermined range within its normal range, this is taken as an indication of a mixture or probe fault, and the fault suspicion is implemented. As soon as one of the limiting values is reached, the further opening of the tank ventilation valve is actively prevented.

The mixture-control factor is the factor for the mixture deviation (control factor of the lambda control multiplied by the ratio of lambda current value to lambda setpoint value) formed during the tank ventilation phase. Based on the deviation of this factor from its neutral value (one), the charging of the regeneration gas, and thus the fuel share of the tank ventilation in the total fuel quantity, is adapted.

For the purpose of illustration, the case of leak air is considered, which incorrectly results in a mixture that is too lean. This leads to a continued arithmetic decrease in the charge of the regeneration gas and thus also the fuel portion of the tank ventilation. Therefore, the tank ventilation detects an increasing deviation of the current from the setpoint fuel portion and, as a result, further opens the tank ventilation valve. In this manner, the lower of the mentioned limit values is reached and the fault suspicion set if a mixture continues to be too lean and if it is not within a range within its neutral state.

In order to prevent a further interference effect, a further opening of the tank ventilation valve will not be allowed once the limit value has been reached.

If a fault suspicion has been set, the mixture adaptation is requested, for whose activation a switch to an operating mode with active lambda control is implemented, that is, a switch to homogenous operation in DFI, and the tank ventilation is switched off. In this manner, an existing mixture fault is adapted; if, however, the adaptation values run counter to limit values, a fault is entered. In this manner, the previous suspicion is verified.

A faultily adapted value of the regeneration gas charge is assumed when a fault suspicion is set. Prior to the next opening, the charge will then be reset to a neutral value after the tank ventilation valve has been closed due to operating conditions.

The fault suspicion is reset after the mixture adaptation has been performed.

What is claimed is:

1. A method for diagnosing a mixture formation in an internal combustion engine including combustion chambers and tank ventilation, comprising:

linking a diagnosis to a mixture adaptation, the diagnosis only operating during an active lambda control;

recognizing, outside of the active lambda control, an indication of one of a mixture fault and a probe fault in that, given an active tank ventilation and a non-active mixture adaptation, a fault suspicion is formed when a measurement for an influence of the tank ventilation on a mixture composition takes on implausible values, the measurement being formed assuming an intact system; and requesting, when the fault suspicion is present, the mixture adaptation to verify the fault suspicion.

2. The method according to claim 1, wherein:

the internal combustion engine is operated with direct gasoline injection into the combustion chambers.

3. The method according to claim 2, wherein:

at least in a first operating mode, the internal combustion engine is operated with stratified mixture distribution in the combustion chambers and, in a second operating mode, with homogeneous mixture distribution in the combustion chambers; and the indication of one of the mixture fault and the probe fault is detected outside of the active lambda control in stratified operation.

4. The method according to claim 3, further comprising:

implementing a switchover to a homogeneous operation for diagnostic purposes, when the indication of the one of the mixture fault and the probe fault has been detected in stratified operation, to one of verify and falsify the fault suspicion.

5. The method according to claim 1, further comprising:

using a control device for controlling a tank ventilation system and at least one further function for achieving an efficient combustion of a fuel/air mixture in at least one of the combustion chambers, the tank ventilation system including an activated-carbon filter connected via one of appropriate lines and connections to a tank, an ambient air and an intake manifold of the internal combustion engine, and includes a tank ventilation valve arranged in the line to the intake manifold.

6. The method according to claim 1, further comprising:

forming a precontrol value for a fuel-metering signal for fuel injection into at least one of the combustion chambers as a function of at least a rotational speed and a signal regarding an air quantity drawn in by the internal combustion engine, a faulty adaptation of a fuel quantity to the air quantity being reflected in a signal of an exhaust-gas analyzer probe, from which a controller forms a controlled variable that reduces the faulty adaptation by a multiplicative linkage with the precontrol value.

7. The method according to claim 6, further comprising:

forming an adaptation operation on the fuel-metering signal formation, by forming an average value frm of the controlled variable, and by correction of the fuel-metering signal formation by an adaptation-operation value that is based on the average value of the controlled variable.

8. The method according to claim 1, wherein:

the tank ventilation is implemented in stratified operation instead of the mixture adaptation.

9. The method according to claim 8, further comprising:

deriving, given the active tank ventilation being active, an influence of a regeneration gas on a composition of a total fuel/air ratio from a signal of a lambda probe, from which a fuel concentration of the regeneration gas is learned; and calculating a fuel portion introduced via a tank ventilation valve on the basis of a signal of an exhaust-gas analyzer probe, a measured intake-air quantity, a fuel quantity metered via the injectors, and a regeneration-gas quantity derivable from a control pulse duty factor for the tank ventilation valve and further boundary conditions.

10. The method according to claim 9, wherein:

the fault suspicion is set when the fuel concentration of the regeneration gas of the tank ventilation is outside a plausible range.

11. An electronic control device for diagnosing a mixture formation in an internal combustion engine including combustion chambers and tank ventilation, comprising:

an arrangement for linking a diagnosis to a mixture adaptation, the diagnosis only operating during an active lambda control;

an arrangement for recognizing, outside of the active lambda control, an indication of one of a mixture fault and a probe fault in that, given an active tank ventilation and a non-active mixture adaptation, a fault suspicion is formed when a measurement for an influence of the tank ventilation on a mixture composition takes on implausible values, the measurement being formed assuming an intact system; and an arrangement for requesting, when the fault suspicion is present, the mixture adaptation to verify the fault suspicion.

* * * * *